United States Patent [19]

Fukuroi et al.

[11] Patent Number: 4,686,749

[45] Date of Patent: Aug. 18, 1987

[54] CAPPED EYELET FOR ATTACHING SNAP FASTENER

[75] Inventors: Takeo Fukuroi, Uozu; Akira Tanaka, Kurobe, both of Japan

[73] Assignee: Yoshida Kogyo K.K., Tokyo, Japan

[21] Appl. No.: 789,023

[22] Filed: Oct. 18, 1985

[30] Foreign Application Priority Data

Oct. 22, 1984 [JP] Japan ..... 59-159335[U]

[51] Int. Cl.[4] ..... A44B 1/18

[52] U.S. Cl. ..... 24/691; 24/94; 24/95; 24/113 R

[58] Field of Search ..... 24/691, 692, 682, 688, 24/687, 94, 95, 108, 113 R, 113 MP

[56] References Cited

U.S. PATENT DOCUMENTS

| | | | |
|---|---|---|---|
| 546,349 | 9/1895 | Saunders | 24/94 |
| 3,333,306 | 8/1967 | Daddona, Jr. | 24/216 |
| 3,745,613 | 7/1973 | Daddona | 24/95 X |
| 3,934,314 | 1/1976 | Whysall | 24/113 R |
| 4,509,232 | 4/1985 | Kanzaka | 24/113 R |

FOREIGN PATENT DOCUMENTS

| | | | |
|---|---|---|---|
| 2637156 | 2/1978 | Fed. Rep. of Germany | 24/94 |
| 56-174509 | 12/1981 | Japan . | |
| 63271 | 2/1913 | Switzerland | 24/95 |
| 5424 | of 1914 | United Kingdom | 24/113 MP |

*Primary Examiner*—Peter A. Aschenbrenner
*Assistant Examiner*—Laurie K. Cranmer
*Attorney, Agent, or Firm*—Hill, Van Santen, Steadman & Simpson

[57] ABSTRACT

A capped eyelet, for attachment of a snap fastener member to a garment fabric, comprises an eyelet body including a shank with a flange, a cap covering over the flange and secured to a periphery thereof, and at least one punched buffer wing projecting from the flange and having at least one rib. The buffer wing is resiliently deformable to absorb an endwise force applied to the shank when the eyelet is axially compressed for being joined with a snap fastener member. At that time the rib is engageable with the upper end portion of the shank to assist in absorbing the riveting force.

6 Claims, 8 Drawing Figures

CAPPED EYELET FOR ATTACHING SNAP FASTENER

BACKGROUND OF THE INVENTION

1. Field of the Invention

The present invention relates to an eyelet for a snap fastener composed of a male and a female member, and more particularly.to a capped eyelet for attaching such a fastener member to a garment fabric or the like.

2. Description of the Prior Art

Known capped eyelets for the concerned purposes generally comprise an eyelet body with a flange, and a cap covering thereover, the flange extending outwardly from one end of a cylindrical or tubular shank. In attaching a snap fastener member to a garment fabric, the eyelet body is fastened to the fastener member by deforming a free end of the shank to engage a coupling portion of the fastener member. During this attachment, an endwise force is necessarily applied to the shank toward the cap with the result that the latter is dented and has a scar or scars on its outer surface. This is due to the force applied to the shank which in turn acts on the inner surface of the cap.

U.S. Pat. No. 3,333,306 discloses, as reillustrated here in FIG. 5, an eyelet having a pair of reinforcing wings 6', 6' punched from the flange 2' and folded over to project radially inwardly in such a manner that the under surface of each folded-over wing 6' is flush with the top surface of the flange 2'. The two wings 6', 6' coact with a wall of the shank 4' to absorb the riveting force applied thereto.

Another prior art eyelet, as proposed in Japanese Utility Model Laid-Open Publication No. 56-174506 and reillustrated here in FIG. 6, has more than two reinforcing wings 6'' punched from the flange 2'' and folded over to project radially inwardly in such a manner that each folded-over wing 6'' is disposed in the general plane of the flange 2''. The wings 6'' serve to absorb the riveting force applied thereto.

However, with the arrangement of either U.S. Pat. No. 3,333,306 or Japanese Utility Model Laid-Open Publication No. 56-174506, since the wings 6', 6'' can absorb only incompletely the riveting force applied thereto, it is impossible to prevent the cap B', B'' from being marked with any scar on its outer surface.

SUMMARY OF THE INVENTION

According to the present invention, a capped eyelet comprises an eyelet body including a shank with a flange, a cap covering over the flange and secured to a periphery thereof, and at least one punched buffer wing projecting from the flange and having at least one rib. The buffer wing is resiliently deformable to absorb an endwise force applied to the shank when the eyelet is axially compressed for being joined with a snap fastener member. At that time the rib is engageable with the upper end portion of the shank to assist in absorbing the riveting force.

It is therefore an object of the present invention to provide a capped eyelet which is free from being marked with any scar on the outer surface of a cap when the eyelet is axially compressed to join with a snap fastener member.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 7 is a plan view of an eyelet body of FIG. 1 incorporating an alternative embodiment of the buffer wing rib; and FIG. 8 is a plan view of an eyelet body of FIG. 1 incorporating a second alternative embodiment of a buffer wing rib.

DETAILED DESCRIPTION

Figure 1:
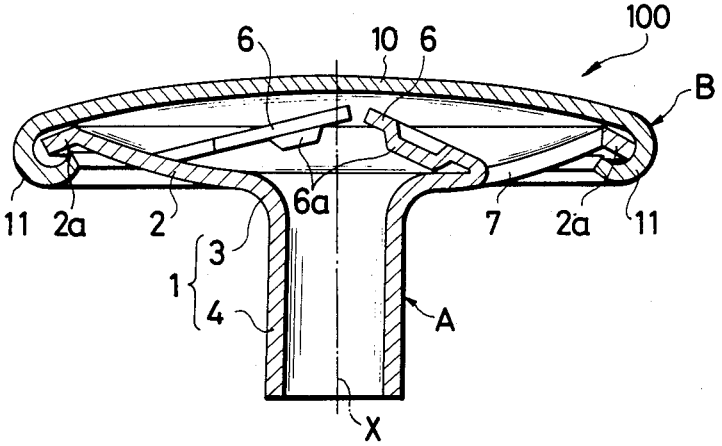
FIG. 1 is a cross-sectional view of a capped eyelet embodying the present invention.

The present invention is particularly useful when embodied in a capped eyelet such as shown in FIG. 1, generally indicated by the numeral 100. The capped eyelet 100 comprises an eyelet body A of metal and a cap B of metal secured thereto.

The eyelet body A includes a tubular shank 1 and a annular flange 2 projecting outwardly from a flared base portion 3 which is contiguous to an upper or one end of the shank 1. The flange 2 is slightly upwardly curved toward its periphery **2*a* and has three buffer wings 6, 6, 6 (FIGS. 1, 2 and 3) punched from the flange 2 and folded over the top surface thereof, there resulting three corresponding apertures 7, 7, 7. Each aperture 7 serves as a drain to allow any water or other liquid substance (collected in the capped eyelet 100 due to washing or plating) to flow out of the eyelet 100**, thus making the latter free from rust.

Figure 2:
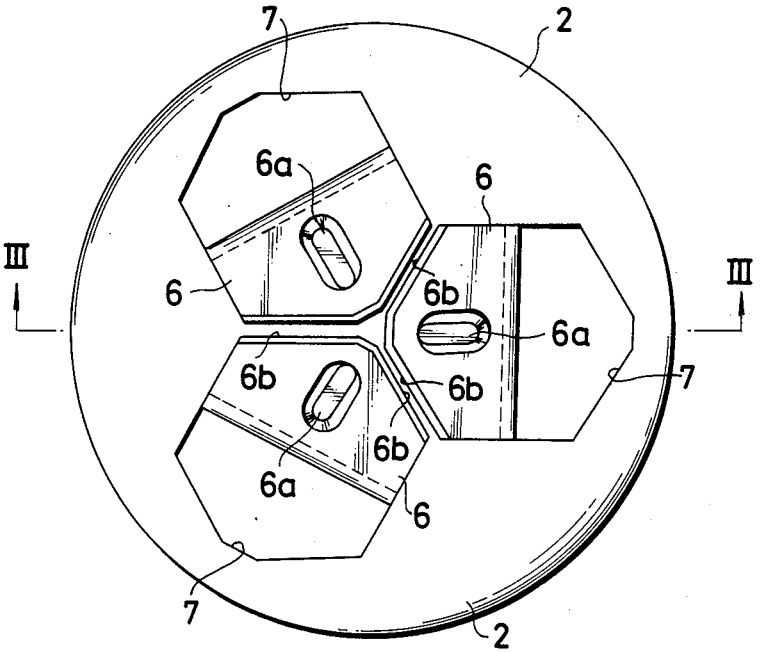
FIG. 2 is a plan view of an eyelet body of FIG. 1.
Figure 3:
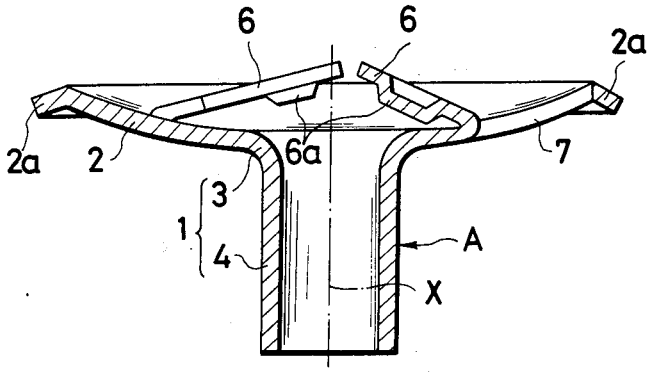
FIG. 3 a cross-sectional view taken along line III-III of 2.

As shown in FIG. 2, the three buffer wings 6, 6, 6 are arranged about the axis X of the eyelet body A at uniform angular distances. Each buffer wing 6 is of a generally pentagonal shape having two inner edges **6*b*, 6*b* disposed at an angle of 120° to each other and extending radially of the circular flange 2. As shown in FIGS. 1 and 3, each buffer wing 6 lies at an angle with respect to the general plane of the flange 2. Each buffer wing 6 has a hollow rib 6*a* projecting from the under surface of the wing 6** for a purpose described below.

Figure 4:
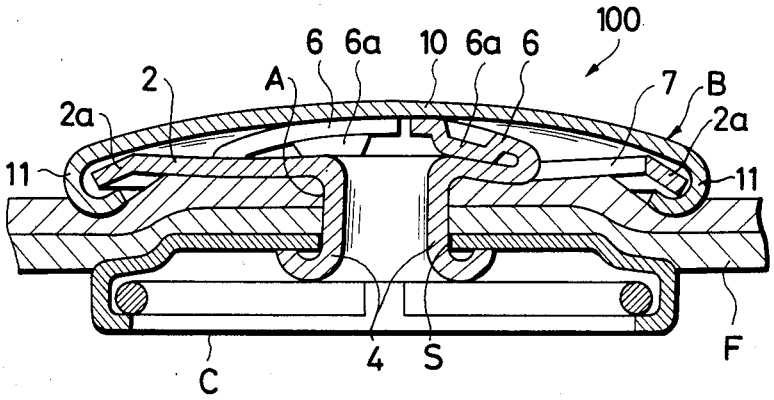
FIG. 4 a cross-sectional view showing the capped eyelet joined with a snap fastener member.
Figure 5:
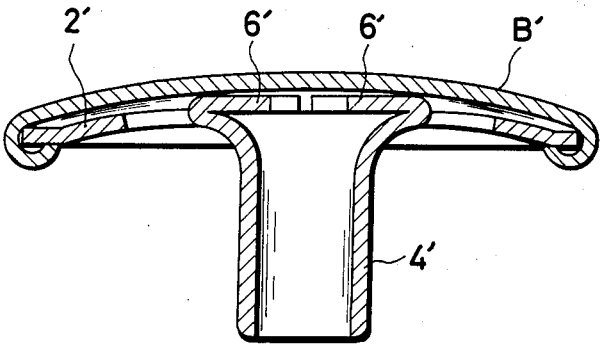
FIG. 5 (PRIOR ART)
FIGS. 5 and 6 are cross-sectional views of prior art capped eyelets.
Figure 6:
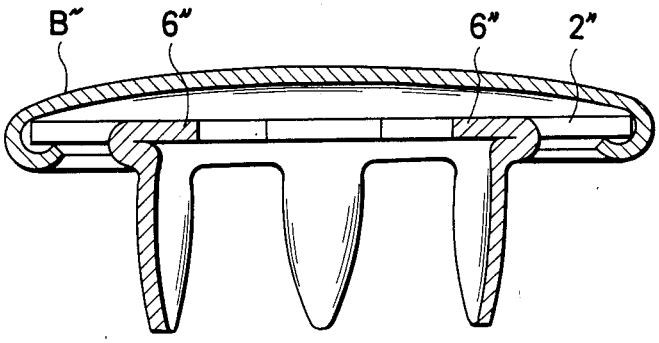
FIG. 6 (PRIOR ART)

FIG. 1 shows the capped eyelet 100 before having been joined with a snap fastener member C (FIG. 4). In such initial form, the flange 2 has a radius of curvature smaller than that of a convex top wall 10 of the cap B.

In assembling the capped eyelet 100, the cap B is joined with the eyelet body A by forcing the peripheral portion 11 inwardly to provide an annular curled edge tightly engaging the periphery **2*a* of the flange 2. In the thus assembled eyelet 100 (FIG. 1), the upper surface of each buffer wing 6** is spaced from the under surface of the top wall of the cap B.

In use, the shank 1 of the assembled capped eyelet 100 of FIG. 1 is forced through a garment fabric F into a hole S of a snap fastener C, and the shank 1 is then axially compressed against the buffer wings 6, 6, 6 and hence the top wall 10 of the cap B to become deformed at its free end portion into an annular curled edge 4 so as to tightly engage the peripheral edge portion of the hole S of the snap fastener member C, as shown in FIG. 4. Thus the snap fastener member C has been attached to the garment fabric F. In this embodiment, the snap fastener member C comprises a female body adapted to receive a male body of a mating snap fastener member (not shown). Alternatively, the snap fastener member C may comprises a male body adapted to be coupled with a female fastener member.

During this attachment, the endwise or axial force acts on the shank 1 so as to push the three buffer wings 6, 6, 6 against the inner surface of the top wall 10 of the cap B. The buffer wings 6 are resiliently deformed or bent toward the flange 2, while the flange 2 is resiliently deformed until it assumes a generally flat or horizontal posture (FIG. 4) in which the radius of curvature of the flange 2 is larger than that of the top wall 10 of the cap B. As a result, an excessive amount of the force applied to the shank 1 is absorbed so as not to cause any scar or mark on the outer surface of the top wall 10 of the cap B. At that time, the ribs 6*a* of the buffer wings 6 are engageable with the upper end of the shank 1 and serve to assist in absorbing the force applied to the shank 1. Thus the capped eyelet 100 has an improved shock-absorbing means which enables the snap fastener member C to be attached to the garment fabric F firmly and accurately without marring the face of the cap B.

In the illustrated embodiment, the rib 6*a* of each buffer wing 6 is of a generally oval shape, as shown in FIG. 2. The rib 6*a* may have an alternative shape such as circular as shown in FIG. 7 at 6*a*′, rectangular as shown in FIG. 8 at 6*a*″ or rhombic. Further, each buffer wing 6 may have more than one rib 6*a*.

Although various minor modifications may be suggested by those versed in the art, it should be understood that we wish to embody within the scope of the patent granted hereon, all such embodiments as reasonably and properly come within the scope of our contribution to the art.

What is claimed is:

1. A capped eyelet for attachment of a snap fastner member tp a garmet, comprising:

(a) an eyelet body having a tubular shank with a longitudinal axis, and a substantially circular flange extending radially outwardly from one end of said shank substantially in a plane, said flange having a plurality of buffer wings projecting axially outwardly from said flange and away from said shank, each of said buffer wings lying at an acute angle with respect to the general plane of said flange, each said buffer wing having a hollow rib projecting from its under surface in overlying relation to said shank;

(b) a cap covering said flange and having a convex top wall and a peripheral edge clinched over a periphery of said flange; and (c) said buffer wings being resiliently deformable for absorbing an axial force applied to said shank when said capped eyelet is axially compressed for being joined to the snap fastener member, said rib of each buffer wing being engageable with said one end of said shank, upon the deformation of said buffer wings, for assisting in absorbing the axial force.

2. A capped eyelet according to claim 1, the number of said buffer wings being three, such three buffer wings being arranged about the longitudinal axis of said eyelet body at uniform angular distances.

3. A capped eyelet according to claim 2, each of said three buffer wings of a generally pentagonal shape having two inner edges disposed at an angle of 120° to each other and extending radially of said flange.

4. A capped eyelet according to claim 1, said rib of each said buffer wing having a generally oval shape.

5. A capped eyelet according to claim 1, said rib of each said buffer wing having a circular shape.

6. A capped eyelet according to claim 1, said rib of each said buffer wing having a rectangular shape.

* * * * *